United States Patent [19]

Woronow et al.

[11] Patent Number: 4,777,067

[45] Date of Patent: Oct. 11, 1988

[54] CUSTOMIZED PHOTOGRAPH COLLAGE AND METHOD FOR MAKING SAME

[76] Inventors: Donald F. Woronow, 25200 Orchard Grove, Southfield, Mich. 48034; Barbara J. West, 11083 Ranch Home Ct., Utica, Mich. 48087

[21] Appl. No.: 33,649

[22] Filed: Apr. 3, 1987

[51] Int. Cl.[4] ..... B44C 5/02

[52] U.S. Cl. ..... 428/39; 156/60; 428/913.3

[58] Field of Search ..... 428/39, 913.3, 542.2; 40/124.4; 156/60; 248/447.1

[56] References Cited

U.S. PATENT DOCUMENTS

| | | | |
|---|---|---|---|
| 683,302 | 9/1901 | Lee | 428/39 |
| 886,606 | 5/1908 | Holmsten | 428/39 X |
| 1,606,724 | 11/1926 | Rutman | 428/39 |
| 2,080,652 | 5/1937 | Cook et al. | 428/39 |
| 2,889,651 | 6/1959 | Baldanza | 428/913.3 X |
| 2,917,188 | 12/1959 | Menin | 428/18 X |
| 3,553,062 | 1/1971 | Berlin | 428/21 |
| 3,574,017 | 4/1971 | Kass | 428/39 X |
| 3,654,717 | 4/1972 | Lane | 428/542.2 X |
| 3,699,738 | 10/1972 | Merideth | 52/284 X |
| 3,868,283 | 2/1975 | Scheyer | 428/14 X |
| 4,061,809 | 12/1977 | Mautner | 428/50 |
| 4,123,862 | 11/1978 | Dyer et al. | 40/152 |
| 4,564,406 | 1/1986 | Binks | 428/39 X |
| 4,684,099 | 8/1987 | Krapf | 428/100 X |

FOREIGN PATENT DOCUMENTS

| | | | |
|---|---|---|---|
| 0077426 | 4/1983 | European Pat. Off. | 428/913.3 |
| 636584 | 5/1950 | United Kingdom | 156/60 |

OTHER PUBLICATIONS

1987; vol. 2; Taylor Gifts Catalog (Reference to p. 2).

*Primary Examiner*—Henry F. Epstein
*Attorney, Agent, or Firm*—Basile and Hanlon

[57] ABSTRACT

A customized photograph collage having a plurality of photographs mounted on backing members of various size, shape, and thickness, are fixed in overlapping and adjoining relationships to form a unitary three dimensional collage and method for making same. A protective coating is applied to the collage to protect against dirt, scratches, and ultra-violet rays. A method for making the customized photograph collage includes the steps of mounting photographs on backing members with an adhesive interposed between the photograph and the backing member, grouping a plurality of the photographs in a layout having overlapping and adjoining relationships to form a three dimensional collage, fastening the overlapping and adjoining portions of the photographs together, stabilizing the collage with a flat surface on the back side of the collage, and coating the collage with a protectant to protect against dirt, scratches, and ultra-violet rays.

2 Claims, 1 Drawing Sheet

CUSTOMIZED PHOTOGRAPH COLLAGE AND METHOD FOR MAKING SAME

BACKGROUND OF THE INVENTION

1. Field of the Invention

The invention relates to a three dimensional collage, more specifically, to a customized photograph collage and a method of making the same.

2. Description of the Prior Art

Various types of collages and methods for making the collages are, generally speaking, known in the art. For example, U.S. Pat. No. 3,868,283 to Scheyer discloses a three dimensional picture, which is made by cutting and trimming various elements from a plurality of copies of the same photograph. Each element is individually mounted on the base photograph using shims to provide depth in the three dimensional picture. U.S. Pat. No. 3,574,017 to Kass discloses an ornamental system and a method for forming a pictorial composition. A guide sheet with a plurality of outline objects is used to precisely position the variously shaped objects to form the completed pictorial composition. U.S. Pat. No. 1,606,724 to Rutman shows a picture made of numerous pieces of fabric, which overlay one another and are secured to a base fabric by glue. U.S. Pat. No. 683,302 to Lee discloses a collage constructed of various pieces of colored paper, which are mounted next to one another or super imposed in a similar manner. U.S. Pat. No. 2,080,652 to Cook et al., discloses another method of making a collage using colored pieces of crepe paper. U.S. Pat. No. 886,606 to Holmsten discloses a multiple picture and method of making the same, in which portions or strips of one picture are mounted on the base at right angles to a second picture. Depending on the angle of view, the viewer sees one picture or the other. U.S. Pat. No. 4,564,406 to Binks teaches an iron-on transfer.

In the present invention it is desirable to provide a customized photograph collage, which is constructed of a plurality of pictures separately mounted and joined together to form a unitary three dimensional collage.

SUMMARY OF THE INVENTION

A customized photograph collage is disclosed, having a number of photographs mounted on backing members which are fastened together in overlapping and adjoining relationships to form a three dimensional collage. The collage is stabilized by providing a flat surface on the back side of the collage for hanging, and the collage is protected against dirt, scratches, and ultra-violet rays by a washable protective coating. Each photograph is mounted on a backing member using an adhesive. A group of mounted photographs are laid out in overlapping and adjoining relationships to form a three dimensional collage. The overlapping and adjoining portions of the group of mounted photographs are fastened together to form a unitary collage. The collage is stabilized by providing a flat surface on a back side of the collage at selected portions of the backing members. The collage is coated with a protectant to protect against dirt, scratches, and ultra-violet rays.

DESCRIPTION OF THE PREFERRED EMBODIMENT

Figure 1:
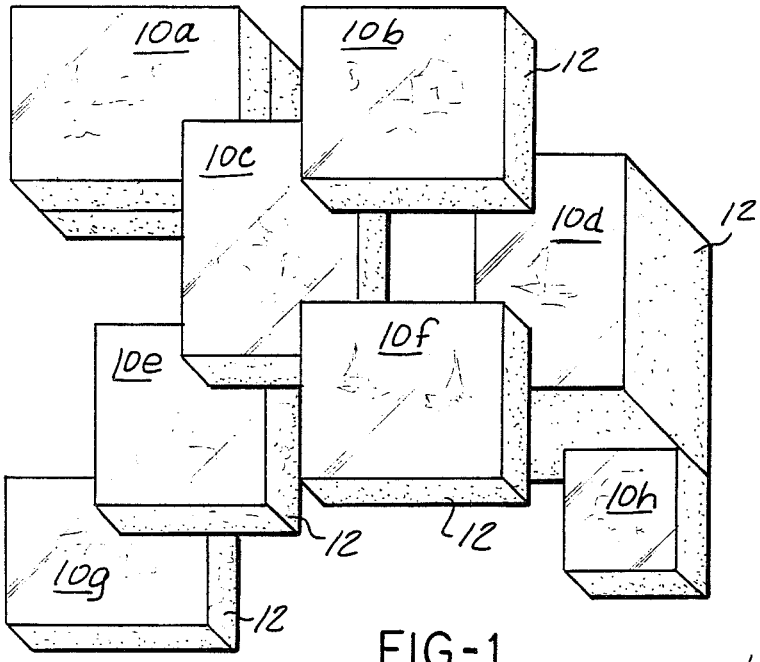
FIG. 1 is a perspective view of one of the numerous possible configurations of a customized photograph collage.
Figure 2:
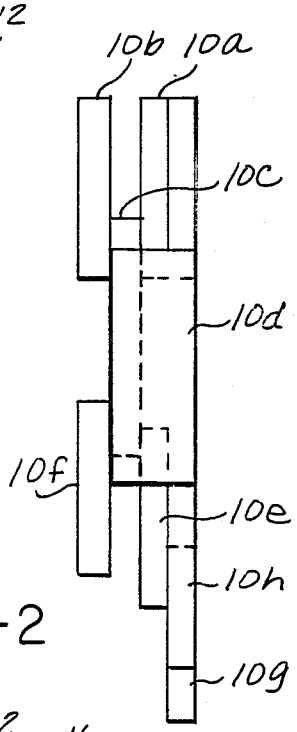
FIG. 2 is a side view of the customized photograph collage shown in FIG. 1.

A perspective view of a representative configuration of a customized photograph collage is shown in FIG. 1. The representative configuration of the customized photograph collage includes a plurality of photographs, designated 10*a* through 10*h* respectively. Each photograph, designated generally as 10, has a corresponding backing member 12. The backing members 12 are preferably constructed of light weight material, such as styro-foam or other foam core materials.

Figure 3:
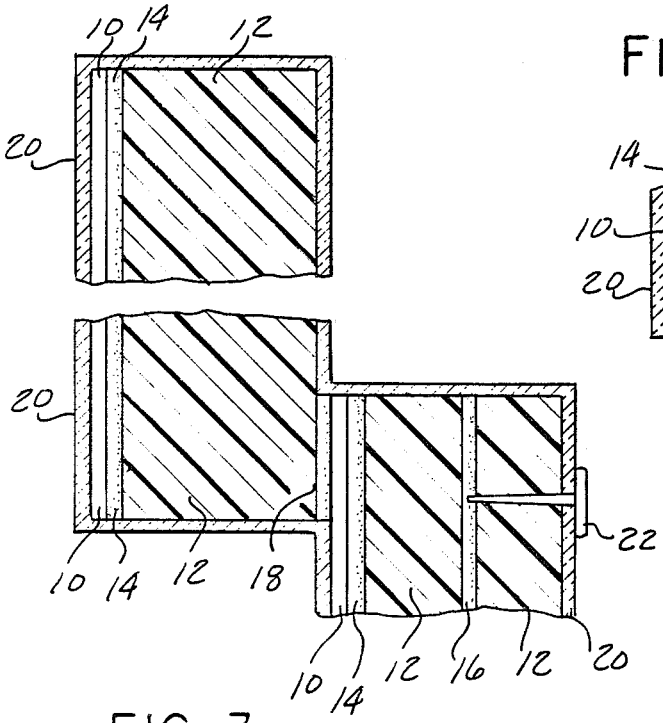
FIG. 3 is a cross-sectional view of a typical overlapping joint of the customized photograph collage.
Figure 4:
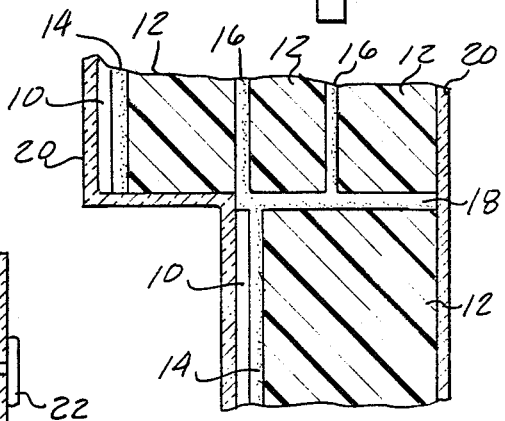
FIG. 4 is a cross-sectional view of a typical adjoining joint of the customized photograph collage.

Means for mounting the photograph 10 to a backing member 12 are provided. As shown in FIGS. 3 and 4, the mounting means can comprise a first layer of adhesive 14 interposed in between the photograph and the backing member 12. The first layer of adhesive 14 is preferably an organic adhesive, such as those which are commercially available and preferably made with a wheat paste or silicone base. The first layer of adhesive 14 is also preferably pressure sensitive. The first layer of adhesive 14 is applied to the back of the photograph 10 and the front or the backing member 12. The adhesive 14 is allowed to dry to a desired consistency. The photograph 10 is mounted to the backing member 12 with the adhesive 14 interposed between the photograph 10 and the backing member 12. The photograph 10 and the backing member 12 are vacuum pressed together for approximately 10 minutes to assist proper adhesion between the photograph 10, the adhesive 14, and the backing member 12. The photograph 10 and the backing member 12 can be cut to any desired size, shape, and thickness.

If additional thickness is required, additional backing members 12*b* can be affixed to the first backing member 12 to achieve the desired thickness. To build up the thickness of the backing member 12, a second layer of adhesive 16 is applied to a rear side of the first backing member 12 and the front side of backing member 12*b*. The adhesive layer 16 may be similar in composition to the adhesive layer 14. The adhesive 16 is allowed to dry to a desired consistency. The first and second backing members 12, 12*b* are then mounted together with the adhesive 16 interposed between them. The multiple layers can then be vacuum pressed together for approximately 10 minutes to assure adequate adhesion. As previously described, the built up composition can be cut to any desired size, shape, or thickness.

A group of photographs 10 are laid out in overlapping and adjoining relationship to create a three dimensional collage. A grid, having a plurality of spaced horizontal and vertical lines, can be sued in laying out the photographs 10 in order to assure proper alignment of parallel and perpendicular surfaces.

Means for fastening overlapping portions of the photographs 10 together are provided to form a unitary three dimensional collage. The fastening means can comprise a third layer of adhesive 18 interposed in between overlapping and adjoining surfaces of the photographs 10, as shown in FIGS. 3 and 4 respectively. The adhesive layer 18 may be similar in composition to the previously described first and second layers of adhesive, 14 and 16 respectively. The adhesive 18 is applied and affixed as previously described with respect to the first and second layers of adhesive, 14 and 16 respectively.

If necessary, means for stabilizing the collage can be provided by forming a flat surface on a back side of the collage. The back surface of the collage can be made flat by building up selected backing members 12, as previously described, to provide a flat surface for hanging.

Means for protecting the collage against dirt, scratches, and ultra-violet rays are also provided. The protecting means can comprise a washable protective coating 20 applied to an exterior surface of the collage. The protective coating 20 can be a synthetic or naturally derived lacquer. Semi or high gloss lacquers can be used in order to add visual enhancement to the collage. Alternatively, flat or non-gloss lacquer can be applied to produce a mat or mat-like finish on the collage.

If desired, the sides of the backing members may be colored to coordinate with surrounding decor. The colored side edging is preferably applied prior to application of the washable protective coating 20.

Finally, a balancing point of the collage can be determined and a clip 22 for hanging can be attached to the collage at the balancing point. In the alternative, a plurality of hanging clips can be attached to the collage to support the collage in any desired orientation.

The invention and method disclosed herein is readily adapted to the creation of pictures of various classes and description which are suitable to be used in theater lobbies, convention halls, window fashion displays, travel agency displays, and many other illustrative and decorative lines. It is understood that variations and modifications may be effected to the configuration, size, shape, thickness, and photographs used in conjunction with the invention without departing from spirit and scope of the invention as set forth in the appended claims.

What is claimed is:

1. A customized photograph collage comprising:

a plurality of photographs;

a plurality of foam core backing members, each backing member having a selected thickness and having a front, a rear, and a side;

a first adhesive layer holding each photograph to the front of a corresponding backing member to form a mounted photograph;

a second adhesive layer attaching overlapping and adjoining portions and non-overlapping and externally abutting portions of a plurality of mounted photographs to form a three dimensional collage;

a backing mount affixed to the rear of selected backing members to provide a stable, flat, rear surface for hanging; and a washable protectant layer covering the outer surfaces of the collage to protect against dirt, scratches, and ultraviolet rays.

2. A method for making a customized photograph collage, comprising the steps of:

applying a pressure sensitive adhesive to a photograph and a foam core backing member;

allowing the pressure sensitive adhesive to dry to a desired consistency;

mounting the photograph on the backing member with the pressure sensitive adhesive interposed between the photograph and the backing member to form a mounted photograph;

cutting the foam core backing member and the photograph to a desired size and shape;

building up the foam core backing member to a desired thickness;

grouping a plurality of mounted photographs, having varying backing thicknesses, selectively in overlapping and adjoining relationship and in non-overlapping and externally abutting relationship to create a three dimensional collage;

applying an adhesive between overlapping and adjoining portions of the mounted photographs;

fastening overlapping and adjoining portions of the mounted photographs together, in said overlapping and adjoining relationship and in said non-overlapping and externally abutting relationship, with the adhesive;

stabilizing the mounted collage with backing mounts on a rear side of the collage to provide a flat surface for hanging;

determining a balanced point of the collage;

attaching a clip to the collage for hanging; and applying a washable protective coating to all external surfaces of the collage to protect against dirt, scratches, and ultraviolet rays.

* * * * *